United States Patent [19]

Velechovsky

[11] Patent Number: 4,989,645

[45] Date of Patent: Feb. 5, 1991

[54] MISPICK REMOVAL

[75] Inventor: Petr Velechovsky, Liberec, Czechoslovakia

[73] Assignee: Elitex koncern textilniho strojirenstvi, Liberec, Czechoslovakia

[21] Appl. No.: 279,582

[22] Filed: Dec. 2, 1988

[30] Foreign Application Priority Data

Dec. 2, 1987 [CS] Czechoslovakia ..... 8741-87

[51] Int. Cl.[5] ..... D03D 47/30

[52] U.S. Cl. ..... 139/116.2; 139/435.5

[58] Field of Search ..... 139/116 A, 435, 116.2, 139/435.5

[56] References Cited

U.S. PATENT DOCUMENTS 4,448,222 5/1984 Arakawa ..... 139/435.5
4,487,236 12/1984 Gunneman ..... 139/435
4,781,221 11/1988 Onishi et al. ..... 139/116 A

*Primary Examiner*—Andrew M. Falik
*Attorney, Agent, or Firm*—Klein & Vibber

[57] ABSTRACT

A device for removing an incorrectly inserted weft on a jet loom includes nozzles, a scissor locking device, and a suction device operated in response to signals from sensors sensing the position of the weft. The incorrectly inserted weft picking length is removed in the shape of an evolving loop in the direction towards the shed end side by a pull exerted on the whole subsequent picking length of the weft.

5 Claims, 4 Drawing Sheets

MISPICK REMOVAL

FIELD OF THE INVENTION

The invention relates to a method of removing a weft incorrectly inserted on a jet loom, and a device for carrying out the method.

BACKGROUND OF THE INVENTION

The introduction of electronics into weaving technology has been accompanied, from the very beginning, by efforts aimed at removing the causes of jet loom run interruption. One of these causes is an incorrect weft insertion which is detected by a weft stop motion which then gives a signal to stop the machine run. The chief problem in this operation is how to release the incorrectly inserted but already beaten-up weft, especially with fine staple yards.

There are several known mechanisms for this purpose and they can be classified substantially into three groups, viz., mechanisms for drawing out the weft in its axis without releasing it previously, mechanisms releasing the weft by its transverse displacement with subsequent drawing out in the pick axis, and finally mechanisms producing on the incorrectly inserted weft a wave progressing in the pick axis to release the weft progressively and to draw it out then in the pick axis.

The first of these known mechanisms is relatively simple mechanically but not applicable to fine staple yarn wefts due to a high degree of risk of damaging these wefts. A common drawback of the other two mechanisms is their complexity.

There are also several known devices for automatically removing an incorrectly inserted weft. With one of them, the incorrectly inserted, beaten-up and cut off weft is first released by shaft motion, then gripped by manipulator tongs and drawn towards the main jet so as to be presented to the winding device which finishes the removal of the weft from the shed. Another known device for automatic removal of an incorrectly inserted weft operates on a similar principle using its non-separation, and achieving the presentation of the weft to the take down device by means of a portion of the supply of the metering device fed by an ancillary jet. The drawing-off proper is directed towards the main jet, like in the above mentioned known device.

The drawback of the above-mentioned devices is that for releasing the beaten-up weft from the shed, especially with staple yarns, a considerable force is required, in many cases superior to the strength of the weft to be removed. For this reason, the removal of incorrectly inserted wefts by means of such devices is difficult, sometimes even impossible on fine staple yarns. Besides, the devices themselves are considerably complicated and accordingly costly.

SUMMARY OF THE INVENTION

These drawbacks of the known solutions are eliminated by the method for removing an incorrectly inserted weft according to the present invention. The principle of the method of the present invention includes the incorrectly inserted picking length of the weft being removed in shape of the loop evolving to the shed-end side by a pull exerted on the whole (after the whole) subsequent pick length of the weft.

The principle of the device for carrying out the method according to the invention includes a release mechanism situated on the measuring device, a device for re-tensioning the weft situated between the main jet and the measuring device, ancillary scissors, a plurality of blowing-off jets, each of which is arranged in relation with one of a plurality of relay-like arranged jets, a locking device of main scissors, and a winding-off (drawing-off) device situated on the shed-end side of the jet loom.

Advantages of the device for carrying out the method according to the invention include the ability to remove an incorrectly inserted weft, even of a fine staple yarn, by simple means, without mechanical intrusion into the warp area, in a very non-aggressive manner taking due consideration of fine staple yarn properties.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
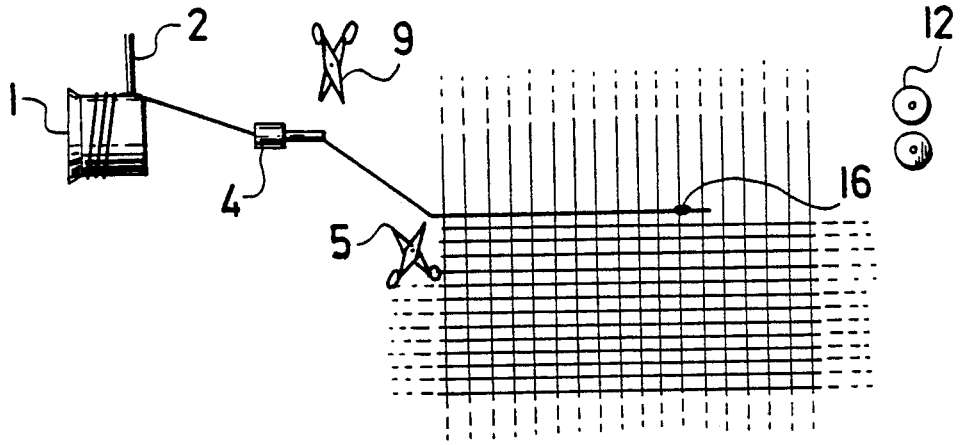
FIGS. 1, 2 and 3 show, schematically, the phases of action of the method according to the invention.

The device for performing the method according to the invention (FIG. 4) is intended for cooperation with standard mechanisms of a jet weaving machine (not shown). These mechanisms include: a weft measuring device 1 of any currently used type, mounted on the machine frame; a main jet 4 mounted on the sley, having a mixing chamber 18 and an outlet mouth 19, and controlled by valve 20; main scissors 5 driven by a cam 6 and a riser 7, into which a blocking device, consisting of an air bag 8 and a valve 26, is inserted; successively operated auxillary jets 10 fed with air pressure via valve 23 and mounted on a sley (not shown) adjacent to reed 17, which is fixed to the weaving machine sley (not shown), and provided with a sensor of a weft pick stop motion 13 and a sensor of a mispick stop motion 14.

The inventive device includes a release mechanism 2, which is mounted on the weft measuring device 1. The release mechanism 2 preferably comprises an electromagnetically actuated needle. A weft tensioning device 3 is mounted on the sley. The weft tensioning device is actuated by valve 30, and comprises a mixing chamber 21 and an outlet mouth 22 oriented oppositely relative to mouth 19 of main jet 4, or oriented perpendicularly to the weft between the weft measuring device 1 and the main jet 4.

The inventive device also includes ancillary scissors 9, which are controlled by cylinder 28 and valve 29, and are fixed to the sley between mouth 19 of the main jet 4 and reed 17, blowing down jets (nozzles) 11 fixed to the sley and made as a body with an outlet hole, e.g. a tube connected to the air pressure distribution 32 by valve 21 and placed at the perpendicular lateral (side) wall of the successively operated auxiliary jet 10, a locking device of the main scissors 5 for prevention of the separation of the mispicked weft 16, the locking device being made e.g. as an air bag 8 connected to the air pressure distributor 32 by valve 26, inserted as a transmission member into the drive mechanism 7 of main scissors 5, and a withdrawing mechanism 12 situated on the shed-end side of the weaving machine, made in the form of a suction nozzle consisting of a mixing chamber 24 with an outlet mouth 25, and connected to the air pressure distributor 32 by valve 27.

The device can be controlled by a not represented control center, for instance by a microprocessor.

Figure 2:
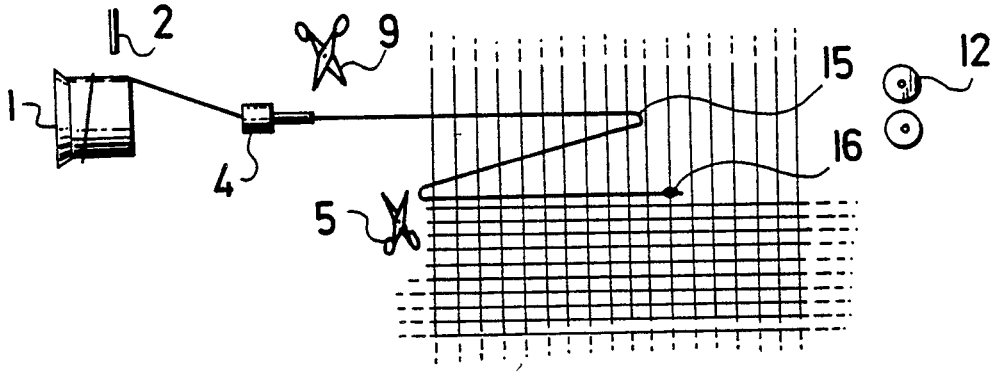
Figure 3:
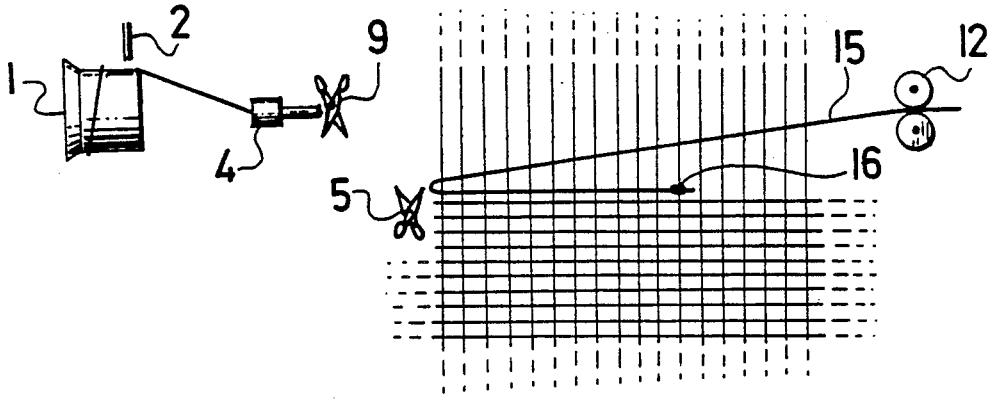

The sequence of operations to be carried out for removing an incorrectly inserted weft according to the method of this invention may be seen from the sequence diagram (FIG. 6) in connection with FIGS. 1, 2, and 3 showing the phases of the operation.

Upon a signal from the picking stop motion sensor 13 or the mispick stop motion sensor 14, which arrives at approximately 60 degrees of angular displacement of the main shaft before the beat-up, machine stoppage in open shed condition takes place.

Simultaneously, an instruction is sent for not separating the mispicked weft 16, this being performed by discharging air pressure from the air bag 8 through valve 26, which is situated in the driving part of the main scissors 5. In that manner, the lift of the cam 6 is transferred only into the air bag 8. Thus, the main scissors 5 do not perform the motion of the cutting blades and, therefore, the mispicked weft 16 is not separated from the weft supply on the weft measuring device 1.

Simultaneously, an instruction is given for temporary release of the weft supply on the weft measuring device 1, e.g. by lifting the release mechanism 2 for a certain part of the machine revolution. This release is necessary for preventing the breakage of the not separated and woven-in weft during the movement of the main jet 4 into the picking position.

Simultaneously, the instruction for re-tensioning the weft is given by activation of the tensioning device 3, e.g. by feeding air pressure to the nozzle by means of the electromagnetic valve 30. Thereby, by pull in the direction opposite to the picking direction, that weft part is tensioned, which was released upon machine stoppage in the space between the main jet 4 and the beat-up straight line, to prevent that released part of the weft from being woven-in upon reverse run of the machine.

Upon reversing the machine to the preceding shed and releasing the mispicked weft 16, the re-tensioning by the tensioning device is stopped. Moreover, it is possible to cancel the instruction of non-separating weft, by re-feeding air pressure into the air bag 8 by means of electromagnetic valve 26.

Figure 5:
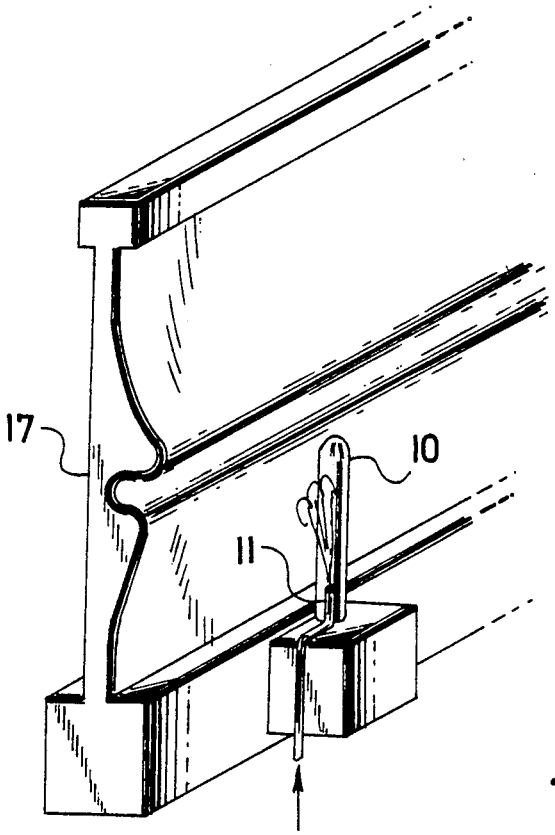
FIG. 5 is a perspective view of a possible version of the blowing-off jet positioning.

In a further step, the blowing down jets (nozzles) 11 are activated by opening valve 31 (FIG. 5), which blow on the vertical side walls of the successively operated auxillary jets 10, thus forming an air cushion, which prevents the weft from being hung up on the successively operated auxiliary jets 10 upon its withdrawal in the form of an evolving loop.

Simultaneously, the withdrawing mechanism 12 is activated by supplying air pressure through valve 27, said withdrawing mechanism being made e.g. in the form of a jet.

Thereafter, the picking of one insertion weft length is performed, which is deposited and measured on the weft measuring device 1, by means of the main jet 4 and the successively operated auxiliary jets 10. The picked weft supply forms a loop 15, because it is at one end connected to the weft on the weft measuring device 1 and at the other end with the mispicked weft situated in the beat-up straight line.

Thereafter, the main jet is set out of operation, loop 15 being thus maintained in tensioned condition by the successively operated auxiliary jets 10 in that part of said loop 15, which is situated in the insertion channel of reed 17. Now, the weft is separated by ancillary scissors 9, which are controlled by pneumatic cylinder 28, to which air pressure is fed by means of electromagnetic valve 29, and the successively operated auxiliary jets 10 bring the released part of loop 15 through the inserting channel of reed 17 to the mouth of the withdrawing device 12.

Then the withdrawing device 12 withdraws the picked and reversed weft and the mispicked weft 16 is connected thereto, in the form of an evolving loop. A signal from the mispick stop motion sensor 14, which at the time the weaving machine is stopped and the unweaving cycle is performed, operates as a supervision of the correctness of the unweaving operation and upon the removal of the weft, the successively operating jets 10, the blowing down nozzles 11 and the withdrawing device 12 are stopped.

Thereafter, the machine is brought into the starting position and restarted.

The device makes possible, in its arrangement, a gentle treatment of the removed weft, and is therefore suitable for performing the method of withdrawing mispicked weft in weaving machines processing particularly fine staple yarns, of which the withdrawal in another manner is difficult, or even impossible.

Figure 4:
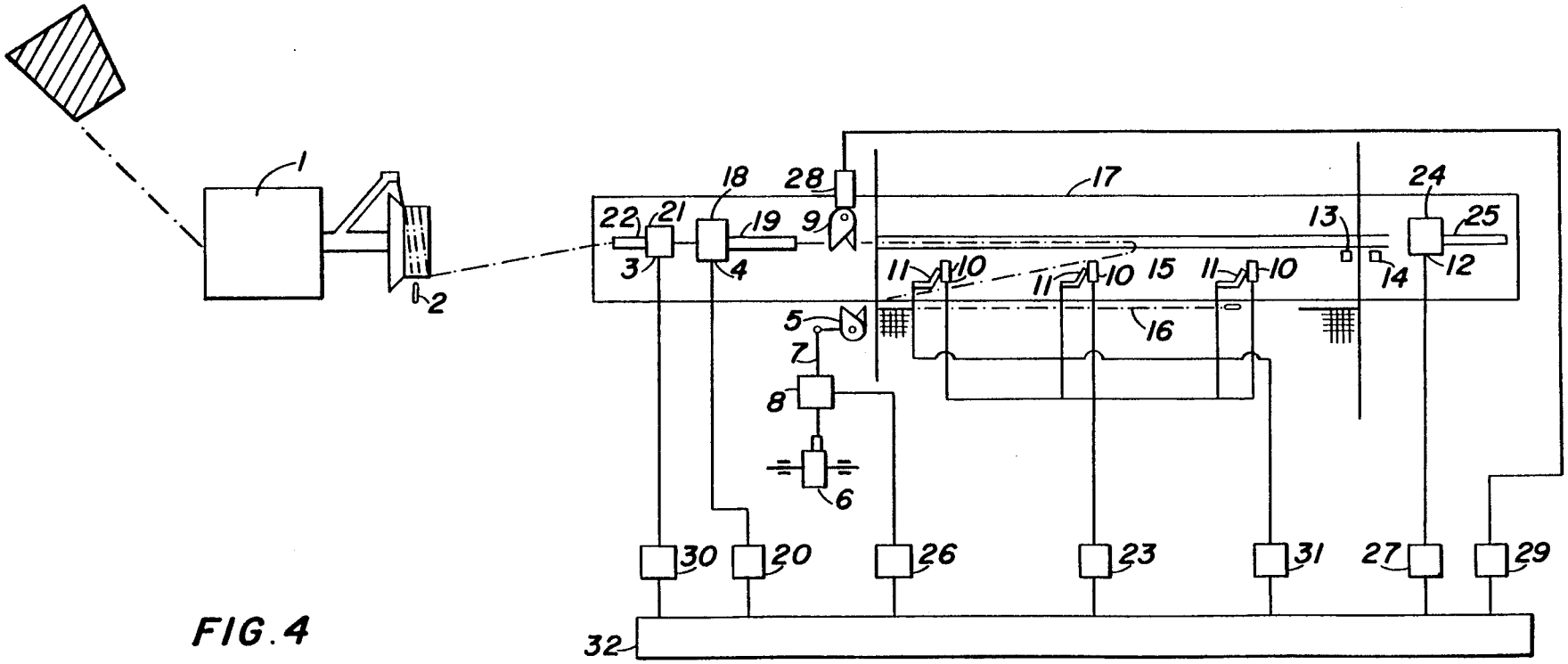
FIG. 4 shows and is a schematic view of an overall arrangement of the device for carrying out the method according to the invention.
Figure 6:
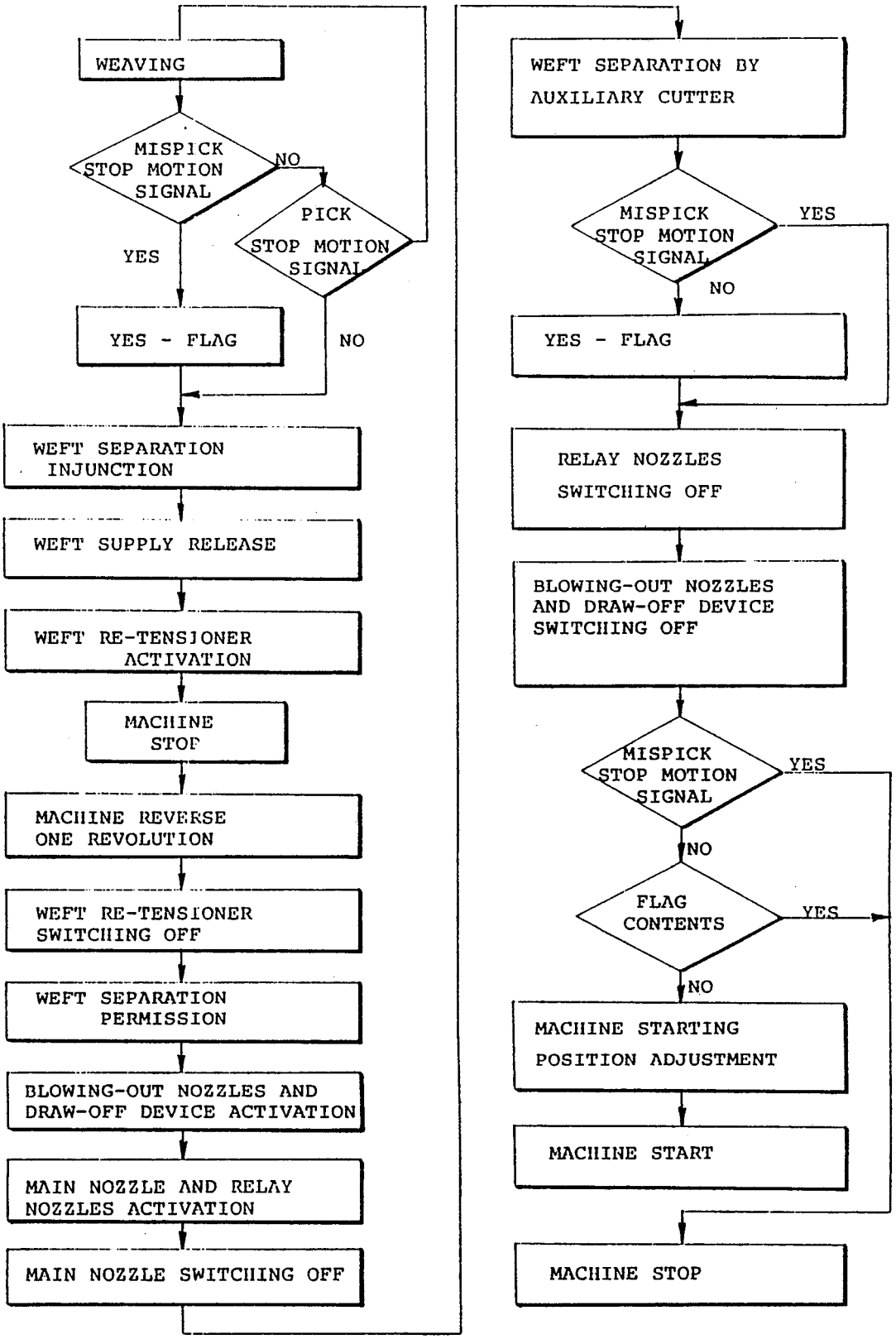
FIG. 6 shows a sequence diagram of the method according to the present invention.
Figure 7:
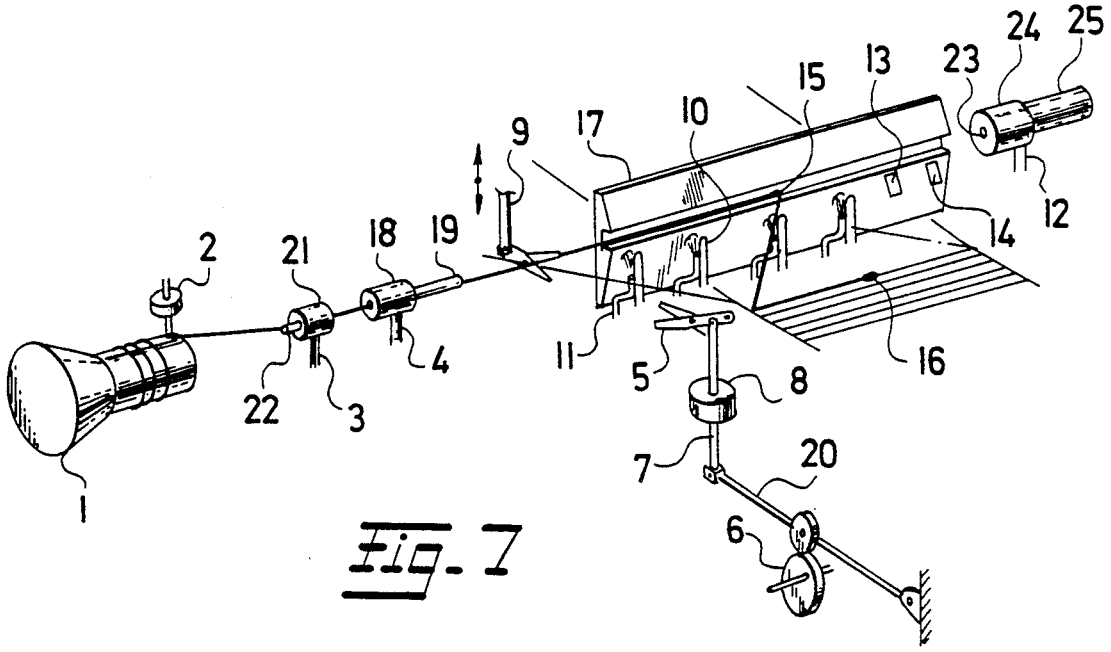
FIG. 7 is a perspective view if elements of the invention shown in FIG. 4.

Referring now to FIG. 6, the steps of the inventive method are illustrated in a flow chart which will be discussed in detail as follows with references to the flow chart shown in parentheses:

During the weaving process (weaving) each inserted weft is sensed by the mispick stop motion 14 and the pick stop motion 13 (FIGS. 4 and 7). When either a positive signal from mispick stop motion 14 is emitted (mispick stop motion signal-yes), or a negative signal from pick stop motion 13 is emitted (pick stop motion signal-no), then the instruction not to separate the mispicked weft 16 (weft separation injunction) follows. In the case of a positive signal from mispick stop motion 14, an indicator (yes-flag) is also set. If the signals of the stop motions 14, 13 are reversed relative to the situation specified above, and weaving process is continued.

Upon the signal for weft separation injunction, air is released from the air bag 8 and, thereupon, the lift of cam 6 reaches only the air bag 8, and is not transferred to the main scissors 5. Then, by lifting the release mechanism 2 on the weft measuring device 3, the weft supply is released for a predetermined interval, i.e. a predetermined part of the machine revolution (weft supply release).

Immediately, the weft is retensioned (weft re-tensioner activation) by activating the weft re-tensioning device 3, during machine stoppage (machine stop) for the purpose of preventing the previously released weft section from being woven in during the reverse stroke of the weaving machine which follows (machine reverse one revolution).

After the reverse stroke and the release of the mispicked weft 16, the retensioning device 3 is set out of operation (weft re-tensioner switching off). Then, the main scissors 5 are unlocked to allow separation of the weft (weft separation permission). Thereafter, the blowing down jets 11 and the drawing-off device 12 are activated (blowing-out nozzles and draw-off device activation). Then, the main jet 4 and the relay-like auxiliary jets 10 are activated for picking the weft from the weft measuring device in the form of loop 15 into the drawing-off device 12 (main nozzle and relay nozzles activation). The main jet 4 is then set out of operation (main nozzle switching off), the weft is separated by the ancillary scissors 9 (weft separation by auxiliary cutter) and drawn off by the drawing-off device 12 in tensioned condition in the form of loop 15, maintained by means of relay-like jets 10.

Upon finishing the withdrawal of weft 16 by the drawing-off device 12, this is indicated by the mispick stop motion 14 (mispick stop motion signal-yes, in the right hand column of FIG. 6), and by this indication, the relay-like jets 10 are set out of operation (relay nozzles switching off), the blowing down jets 11 and the drawing-off device 12 are also set out of operation (blowing-out nozzles and draw-off device switching off).

Thereupon, by a signal from the mispick stop motion 14 (mispick stop motion signal in the middle of the right column of FIG. 6), the machine is either stopped (machine stop) or, depending on the flag contents (flag contents), the weaving machine is adjusted into its starting position (machine starting position adjustment) and then started (machine start) and the weaving process is continued.

Although the invention is described and illustrated with reference to a preferred embodiment thereof, it is to be expressly understood that it is in no way limited to the disclosure of such preferred embodiment but is capable of numerous modifications within the scope of the appended claims.

I claim:

1. An apparatus for removing a mispicked weft length in jet weaving machines, comprising a weft measuring device and a release mechanism mounted on the weft measuring device;

a main jet and a weft tensioning device mounted between the main jet and the weft measuring device;

ancillary scissors and a plurality of blowing-down jets, each blowing down jet being attached to a successively operating auxiliary jet;

a main scissors blocking device and;

a withdrawing device mounted on a shed end side of the weaving machine;

outlet holes of the blowing-down jets being directed along sides of the successively operating auxiliary jets.

2. An apparatus as claimed in claim 1, wherein the weft tensioning device consists of a jet which is directed oppositely to the main jet.

3. An apparatus as claimed in claim 1, wherein the main scissors blocking device comprises an air bag inserted into a driving part of the main scissors.

4. An apparatus as claimed in claim 1, wherein the withdrawing device mounted on the shed end side of the weaving machine comprises a withdrawing nozzle.

5. An apparatus as claimed in claim 1, wherein the weft tensioning device comprises a jet directed perpendicularly towards the weft in the space between the main jet and the weft measuring device.

* * * * *